United States Patent [19]

Hala

[11] 3,964,219

[45] June 22, 1976

[54] INSERT AND ANCHOR POSITIONING AND LOCATING DEVICE

[75] Inventor: Alfred A. Hala, Islip, N.Y.

[73] Assignee: Hohmann & Barnard, Inc., Hauppauge, N.Y.

[22] Filed: May 5, 1975

[21] Appl. No.: 574,395

[52] U.S. Cl. ..... 52/105; 52/699; 52/707; 249/93

[51] Int. Cl.[2] ..... E04B 1/38

[58] Field of Search ..... 52/699, 707, 700, 701, 52/105, 374, 373, 702, 371, 372; 249/93, 91, 83, 13

[56] References Cited

UNITED STATES PATENTS

| | | | |
|---|---|---|---|
| 2,780,936 | 2/1957 | Hillberg | 52/699 |
| 3,912,218 | 10/1975 | Lister | 249/93 |
| 3,913,881 | 10/1975 | Gobler | 249/93 |

*Primary Examiner*—John E. Murtagh
*Attorney, Agent, or Firm*—Philip D. Amins

[57] ABSTRACT

An insert and anchor positioning and locating device is provided for initially locating and positioning anchors and inserts with respect to subsequently poured concrete structures. The device comprises a preselected anchor or insert which is secured to a positioning tab in a detachable manner and selectively employs a frangible material, such as an expanded polystyrene sold under the trademark "Styrofoam". The positioning tab is secured to the styrofoam, when such is employed, and the tab has indicia thereon for positioning the same with respect to preselected places on forms used for pouring of concrete. The tabs are provided with holes for fixedly, but removably positioning the tabs with respect to the forms.

66 Claims, 22 Drawing Figures

70
72
74
71
30A
32A
36A
38A
34A
46A
50A
7
8
60A
56A
52A
54A
48A
76
78
80
42A
84
82
58A

INSERT AND ANCHOR POSITIONING AND LOCATING DEVICE

BACKGROUND OF THE INVENTION

The present state of the art, with regard to the locating and positioning of metal anchors and inserts to wooden forms used for pouring of concrete, requires the use of a skilled carpenter. Obviously, the use of such a skilled craftsman is expensive. The carpenter is required to locate the desired position of the anchor or insert and then cut out portions of the wood forms. Once this has been accomplished, he must then nail, or otherwise secure the anchors or inserts to the forms in a very careful manner so as to ensure that the anchors or inserts will be properly positioned and set in the resultant poured concrete structure; e.g., a wall or floor. In other instances, the carpenter must prepare a special insert form and then carefully secure the insert form to the concrete form. The subsequent removal of the securement means or the nails and forms, from the resultant structure also creates problems and is time consuming. However, as discussed above, the major problem encountered is the amount of time required for a skilled workman to initially set and secure the anchors and inserts.

Accordingly, it is the primary object of the present invention to provide a new and novel insert and anchor positioning and locating device for use in concrete constructions.

It is another object of the present invention to provide a device which is provided with a positioning tab having indicia thereon for alignment with markings on concrete forms for properly locating the metal or anchor with respect to the forms and ultimately, the resultant concrete structure.

It is yet a further object of the present invention to provide an insert and anchor locating and positioning device which has a frangible casting which may be easily broken and removed from the resultant concrete structure.

It is yet another object of the present invention to provide an insert and anchor locating and positioning device for securement to concrete forms which may be accomplished easily and simply.

It is still a further object of the present invention to provide a device of the type described hereinbefore which permits the frangible encasement and positioning tab to be easily removed from the metal anchor or insert after the concrete has been poured and has hardened; and the insert has become positionally secured therein.

It is yet a further object of the present invention to provide a device of the type described which permits an anchor or insert to be positioned substantially flush with the finished surface of a resultant poured concrete structure.

It is still another object of the present invention to provide a device as aforedescribed which permits an anchor or insert to be fixedly positioned in a recessed position with respect to the finished surface of resultant poured concrete structures.

BRIEF DESCRIPTION OF THE DRAWINGS

The foregoing and other objects, features, advantages and utilizations of the new and novel insert and anchor positioning and locating device of the present invention will become more apparent from the detailed description hereinafter considered in conjunction with the accompanying drawings, wherein.

DETAILED DESCRIPTION OF THE PREFERRED EMBODIMENTS

Figure 1:
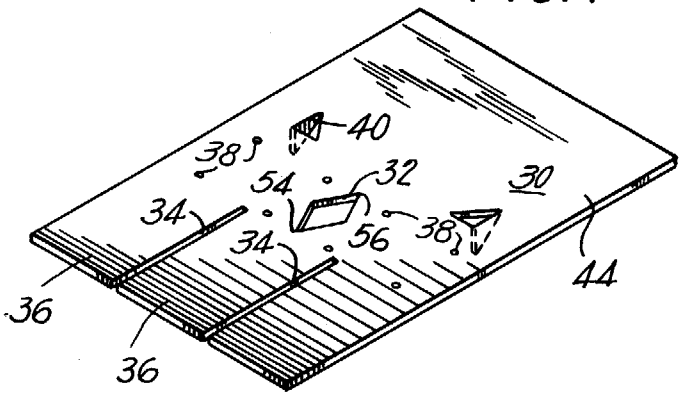
FIG. 1 is a top perspective view of the positioning tab of the insert and anchor positioning and locating device of the present invention.

Referring now to the drawings, and more particularly, to FIG. 1 thereof, there is shown a first embodiment of a positioning tab, generally denoted by the reference numeral 30. The positioning tab is provided with an alignment aperture 32 having a diamond configuration; however, other geometrical configurations of the aperture may also be employed. Laterally disposed on either side of the aperture 32 are longitudinally extending slits or notches 34 which form segregated end portions 36, whose purpose will be discussed more fully hereinafter.

The tab 30 is provided with a series of holes 38 adapted to have nails inserted therein, the purpose of which will be subsequently described. The positioning tab 30 is also provided with a pair of laterally aligned positioning detent members or tangs 40 of substantially triangular shape, which tangs are formed from the tab 30 and project downwardly therefrom.

Figure 4:
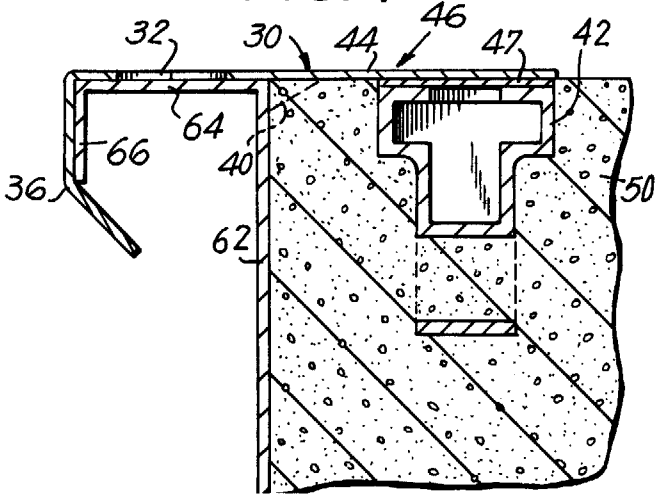
FIG. 4 is a sectional view similar to FIG. 3 wherein the concrete form is fabricated of metal.
Figure 2:
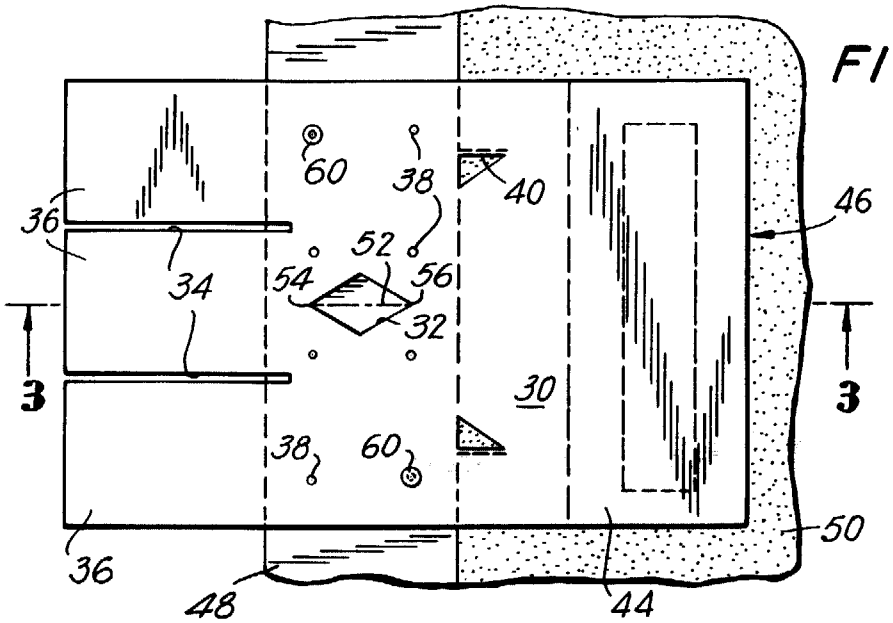
FIG. 2 is a top view of the insert and anchor positioning and locating device in conjunction with a wood concrete form and poured concrete structure.
Figure 3:
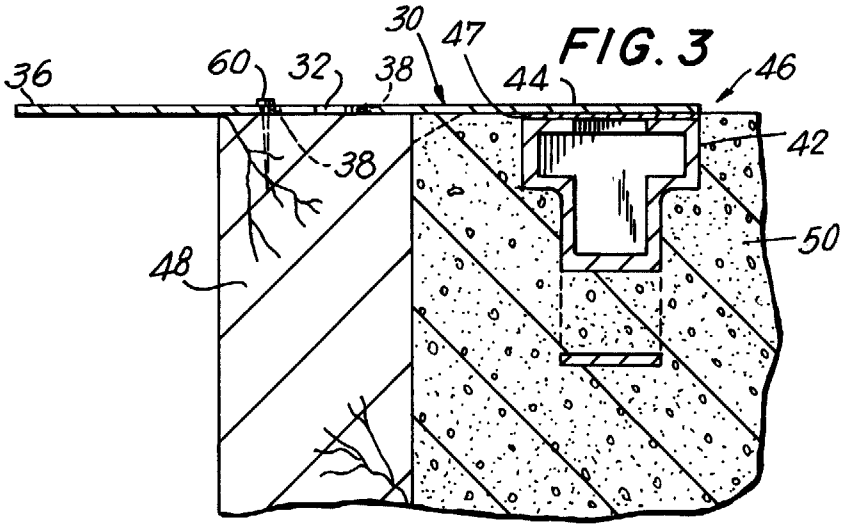
FIG. 3 is a sectional view taken on the line 3—3 of FIG. 2.

The use of the tab 30 for the positioning of a metal anchor or insert is illustrated in FIGS. 2 through 4. The anchor or metal insert may be one of the type made and sold by Hohmann & Barnard, Inc. of Hauppauge, N.Y. The metal insert herein denoted by the reference numeral 42 is of the type designated Insert No. 380-D by the above manufacturer. The insert 42 is secured to the underside of the right hand portion 44 of the tab 30 (as viewed in FIGS. 2–4) to form the first embodiment of the insert and anchor positioning and locating device 46 of the present invention.

The insert 42 is secured to the underside of the portion 44 of tab 30 by means of a double faced adhesive tape layer 47. The layer 47 is preferably a polyvinylchloride foam tape which is compressive so as to compensate for any irregularities which may exist between the metal surfaces. In this regard, attention is directed to the fact that the tab 30 is preferably fabricated of sheet metal while the insert 42 is usually cast metal which inherently has rough and irregular surfaces.

The device 46 is employed to positionally dispose the insert 42 with respect to a wooden concrete form 48 and to locate the insert within the thereafter poured and formed concrete structure, generally denoted by the reference numeral 50. In order to use the device 46, a skilled craftsman, such as a carpenter, marks the wooden form 48 by precisely drawing a center line 52 thereon. Thereafter, a workman positions the device 46 with respect to the form 48 by aligning the longitudinal corners 54 and 56 of the diamond aperture 32 on the center line 52. The longitudinal position of device 46 with respect to form 48 having been so determined, the corresponding lateral position is determined by moving the tab 30 outwardly from the interior of the form 48 until the detent members 40 are disposed in abutting engagement with the interior side wall 58 of the wooden form 48. Once this has been accomplished, the corners 54 and 56 are realigned with center line 52 and two or more nails 60 are hammered through any ones of the holes 38 to fixedly position the device 46 in the desired location. The concrete 50 is then poured and after it has hardened, a workman removes the tab 30 by prying the same from the form 48 and causing the tab 30 and adhesive layer 47 to become disassociated from the insert 42. The insert 42 is thus properly located and secured within the resultant poured concrete structure 50.

It is herein to be noted that the adhesive layer 47 will tear when the same is removed from the insert. Since the adhesive layer is compressible, any part of the tape which remains on the insert will not interfere therewith, thereby leaving the insert in its desired final form within the concrete structure 50.

Since the forms used for pouring concrete structures may also be fabricated of metal, the same is diagrammatically illustrated in FIG. 4. The metal form, designated 62, includes a horizontal flange 64 and a vertical flange 66. The tab 30, and thus device 46, is positioned on flange 64 by having the center line marking thereon (not shown) aligned within the diamond aperture 32, as previously described. The device 46 is fixedly positioned by bending the end portions 36 about the vertical flange 66 in the manner illustrated. It is herein to be noted that the slits 34 divide the left end of the tab 30 (FIG. 1) into the smaller end portions 36 which thereby facilitates the bending of the left end portion about the flange 66 by permitting each of the portions 36 to be bent individually. After the concrete 50 has been poured and hardened, the tab 30 is easily removed from the form 62 by reverse bending of the edge portions 36. The tab 30 is bent around the metal form since the use of nails is not practical when metal forms are employed.

A second embodiment of the present invention is depicted in FIGS. 5 through 8, wherein similar reference numerals denote similar parts. In this embodiment, the insert and anchor positioning device 46A includes a tab 30A having side wall members 70 which depend from the upper wall 72 of the tab; and insert 42A. The device 46A is employed when it is desired to secure the insert 42A in a recessed position with respect to a finished concrete surface. The bottom of the side wall members 70 are provided with inwardly extending coplanar flanges 74 which are disposed in parallel relationship with respect to the upper wall 72.

Figures 5, 6, 7, 8:
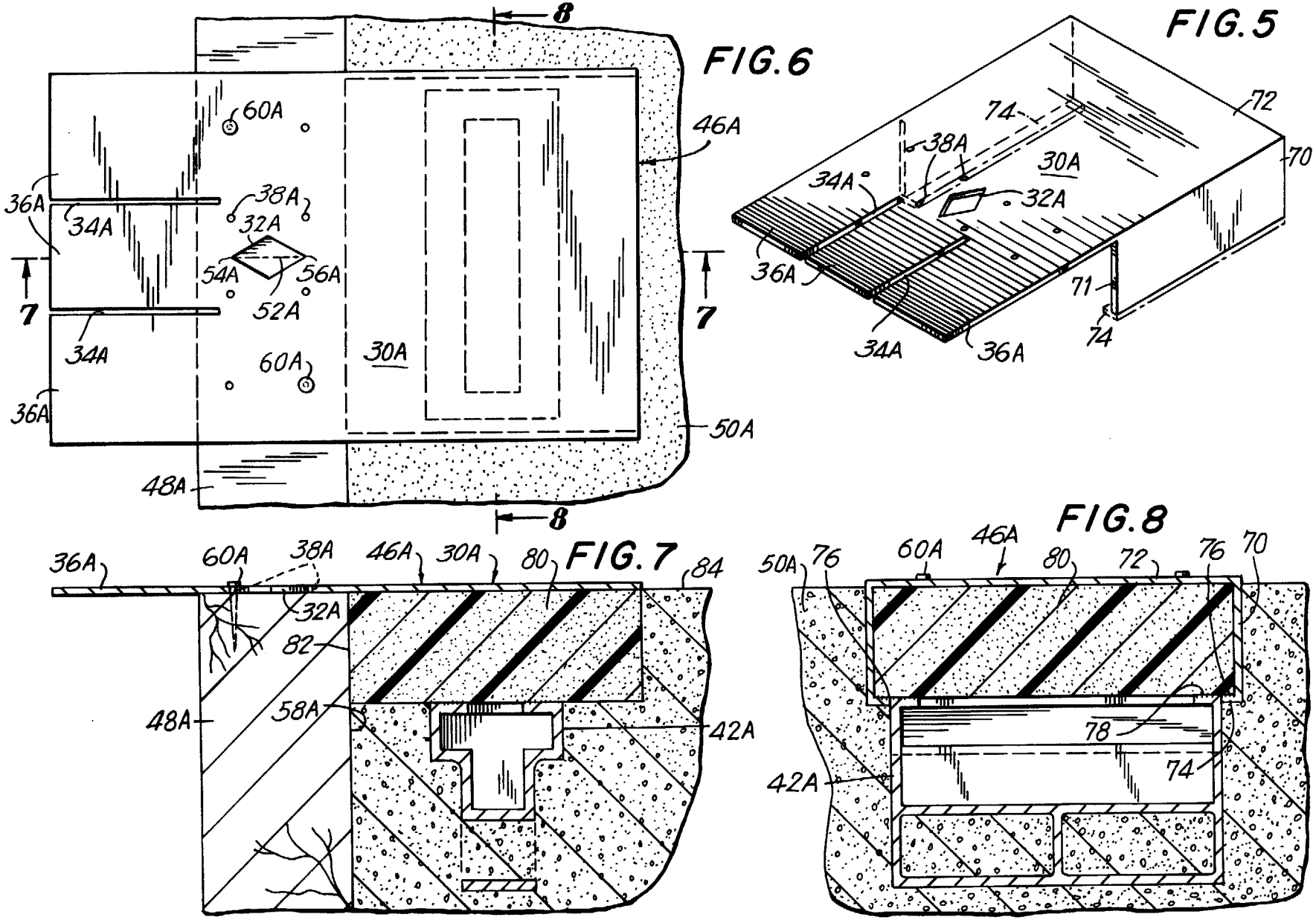
FIG. 5 is a top perspective view of another embodiment of a positioning tab utilized in an insert and anchor positioning device of the present invention.
FIG. 6 is a top view of the insert and anchor positioning and locating device in conjunction with a wood concrete form and poured concrete structure, wherein the anchor or insert is to be recessed with respect to the concrete surface.
FIG. 7 is a sectional view of the device taken on the line 7—7 of FIG. 6.
FIG. 8 is a sectional view of the device taken on the line 8—8 of FIG. 6.

As best seen in FIG. 8, the flanges 74 are tack welded to the insert 42A as at 76. The interior portion of the tab 30A between the upper wall 72 thereof and the upper surface 78 of the insert 42A is filled with a rigid frangible member 80 which is disposed in abutting engagement with the side wall members 70. The frangible member may be fabricated of an expanded foam plastic material, wood or any other suitable material and may be solid or hollow. However, in the preferred embodiment, as herein depicted, the member 80 is fabricated as a solid block of an expanded polystyrene sold under the trademark Styrofoam.

In the utilization of the insert and anchor positioning and locating device 46A, the tab 30A is placed in position upon the wooden form 48A by aligning the corners 54A and 56A of the aperture 32A on the center line 52A (FIG. 6) with the interior side wall 82 of the block 80 being disposed in abuttment with the interior side wall 58A of the form 48A. The tab 30A is then removably secured to the form 48A by the nails 60A extending through the holes 38A and into the wooden form. When this has been accomplished, the insert 42A is then properly located with respect to the thereafter poured concrete structure 50A. After the concrete has been poured and has hardened, the tab 30A is removed by a workman by the use of a hammer or crowbar and the tack weld 76 is relatively easily destroyed, as is the frangible block member 80. The insert 42A is then vertically recessed, as illustrated in FIG. 7, a predetermined distance from the upper surface 84 of the resultant concrete structure 50A, which distance is equal to the height of the block member 80.

It is to be noted that the tab 30A is also provided with longitudinal slits 34A to thereby permit the device 46A to be employed in conjunction with metal concrete forms, as described hereinabove in connection with FIG. 4, by bending of the end portions 36A. Attention is also directed to the fact that the use of the block member 80 obviates the necessity of the tangs 40 provided on the tab 30 of the first embodiment of the invention. In the event the block 80 does not extend beyond the edges 71 of sides 70, the edges 71 may be used in lieu of the tangs 40.

It is herein to be noted that although the foregoing embodiment has been discussed and described as having the tab 30A secured to the insert 42A by means of tack welds 76, it is within the purview and contemplation of the present invention to fabricate the present embodiment of the invention utilizing and incorporating the principles of the first embodiment. In this regard, the tab member 30A may be formed without the side wall 70 and flanges 74, so as to have a substantially planar configuration. The block member 80 may then be removably secured to the tab 30A by a layer of adhesive tape, such as 47 discussed hereinabove, interposed between the undersurface of the upper wall 72 and the upper surface of the block member 80. Similarly, an adhesive tape layer may be interposed between the lower surface of the block member 80 and the upper surface of the insert 42A.

Figure 9:
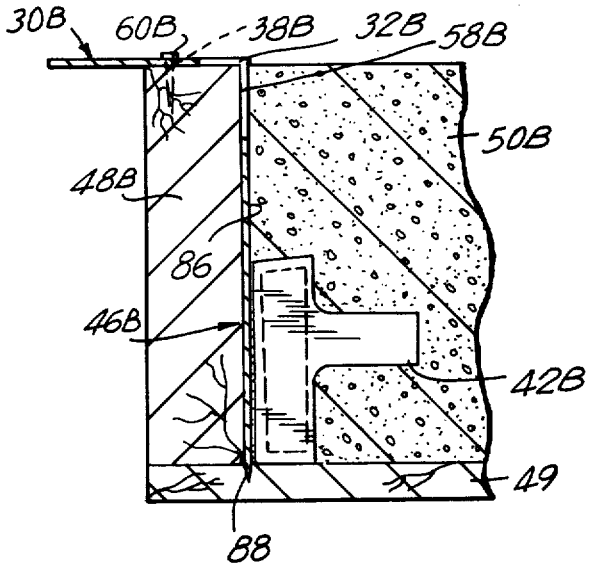
FIG. 9 is a sectional view of another embodiment of the insert and anchor positioning and locating device of the present invention, wherein it is desired to secure the anchor at the bottom portion of the concrete structure.

A third embodiment of the present invention is depicted in FIG. 9, where again similar parts are denoted by similar reference numerals. In this embodiment, the positioning and locating device 46B is of substantially the same construction as described hereinabove in conjunction with FIGS. 1 through 4; however, the tab 30B is bent downwardly so as to located the insert 42B with respect to the side surface 86 of the resultant concrete structure 50B. The tab 30B has the lower edge 88 thereof formed as a nail edge.

In the utilization of the device 46B, the edge 88 is initially hammered into the horizontal wooden form member 49 and the upper end portion of the tab is then bent so as to be disposed upon the wooden concrete form 48B, thereafter, the nails 60B are used to positionally secure the tab 30B in the manner previously described. In this regard, it is to be noted that the aperture 32B may be formed as an elongated slot, or a series of aligned slots. In this manner, the tab 30B is positioned with respect to the center line (not shown) prior to the securement of the device 46B to the wooden form member 49. An insert such as 42B may simply and easily be located on the bottom of side surface 86 of a resultant concrete structure 50B without necessitating a great deal of time, effort and expense in connection therewith.

Figure 10:
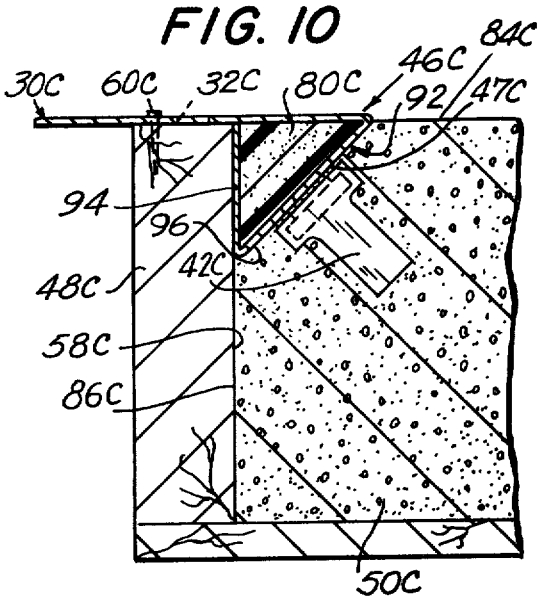
FIG. 10 is a sectional view of another embodiment of the device employed where an insert is required in the corner of a resultant concrete structure.

Another embodiment of the present invention is depicted in FIG. 10, wherein similar parts are donated by similar reference numerals. In this embodiment, a tab 30C has one end thereof folded upon itself to form a right triangular portion 92 with the vertical leg 94 thereof being disposed in abutting engagement with the interior wall 58C of the wooden concrete form 48C, to thereby properly laterally position the device 46C with respect thereto. The device is correspondingly longitudinally positioned by aligning the aperture 32C with a center line marking on the form, whereafter the nails 60C are inserted to fix the position. The insert 42C is secured to the hypotenuse leg 96 of the triangular portion by an adhesive layer 47C, in the manner hereinbefore described. After the resultant concrete structure 50C has hardened, the tab 30C is pried loose from the form 48C and the adhesive layer 47C is broken away from the insert 42C whereby the insert is angularly located with respect to the upper and side surfaces 84C and 86C, respectively, of the resultant concrete structure 50C. In order to prevent any concrete from permeating the triangular portion 92, the same is filled with a triangular block member 80C.

Figure 11:
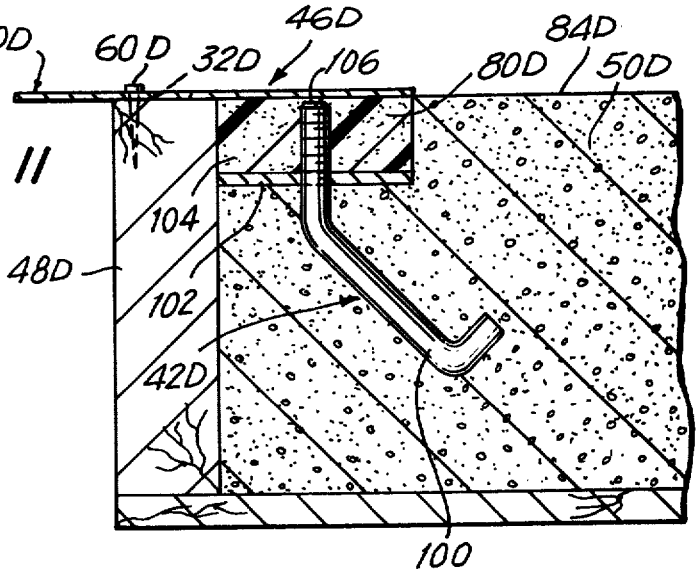
FIG. 11 is a sectional view depicting yet another embodiment of the invention used for the securement of a recessed anchor bolt in a resultant concrete structure.

A further embodiment of the present invention is depicted in FIG. 11, wherein similar parts are denoted by similar reference numerals. A positioning and locating device 46D comprises a tab 30D and an anchor, generally denoted 42D, which in turn comprises an anchor bolt 100 and a bolt plate 102. The upper end portion of the anchor bolt 100 is threaded, as at 104, and is secured to the bolt plate 102 by welding or any other secure manner of engagement.

The tab 30D has a configuration substantially the same as that shown and described in conjunction with that of FIG. 5 and may be tack welded to the bolt plate to form the device 46D. The tab 30D is secured to the wooden concrete form 48D by means of nails 60D in the manner previously discussed by use of the aperture 32D. After the concrete structure 50D has been poured and has hardened, the tab 30D is pried away from the wooden concrete form 48D and the tack weld securing the tab 30D to the bolt plate 102 is destroyed. In the event the foam block member 80D remains upon the threaded portion 104 of the anchor bolt 100, the same may easily be destroyed and removed therefrom so as to leave only the anchor bolt secured in position within the concrete structure 50D with the extreme upper end 106 of the threaded portion recessed with respect to the upper surface 84D of the concrete structure. Although, the tab 30D has herein been described as having a structural configuration similar to that depicted in FIG. 5, the same may also be fabricated as a substantially planar member which is secured to the upper surface of the block member 80D by means of an adhesive tape layer interposed therebetween, as previously described. The anchor bolt 100 may be secured with respect to the block member 80D by merely force fitting the threaded portion 104 of the bolt into said block member. However, if additional securement is desired, than an adhesive layer may be interposed between the bolt plate 102 and the block member 80D.

Figure 13:
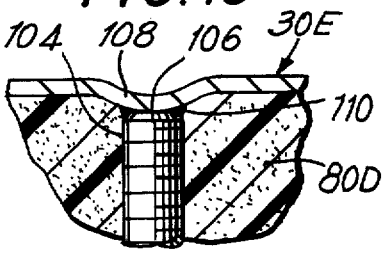
FIG. 13 is a partial sectional view depicting an alternative detail of FIG. 11 for securement of the anchor bolt to the positioning tab.
Figure 14:
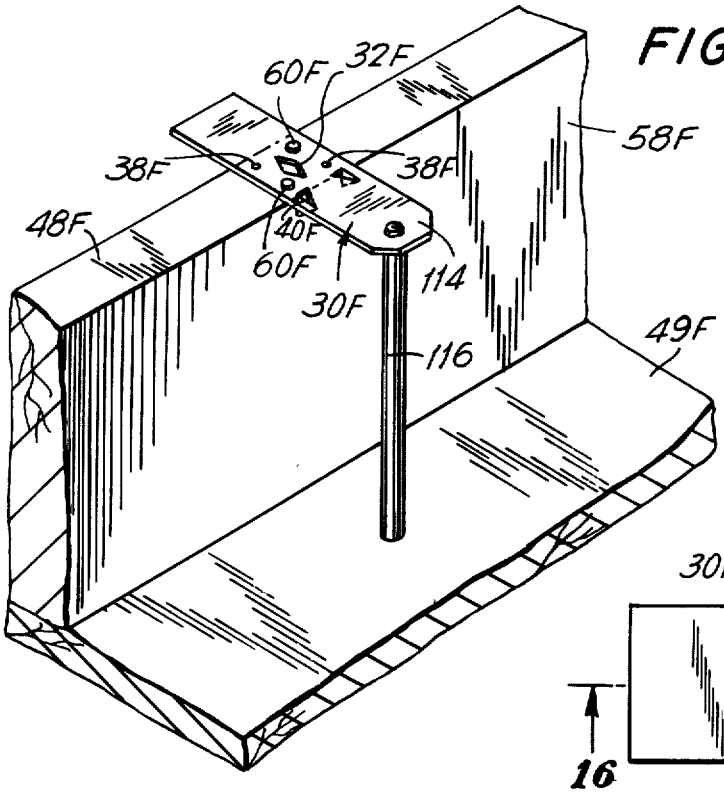
FIG. 14 is a perspective view of another embodiment of the device of the present invention in conjunction with a pair of perpendicularly disposed wood concrete forms.
Figure 15:
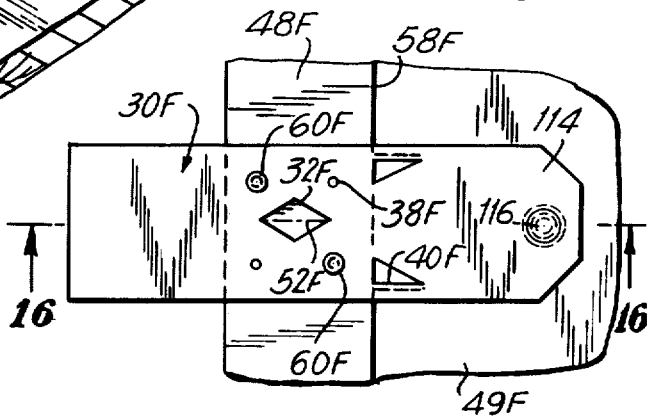
FIG. 15 is a top view of the device depicted in FIG. 14.
Figure 17:
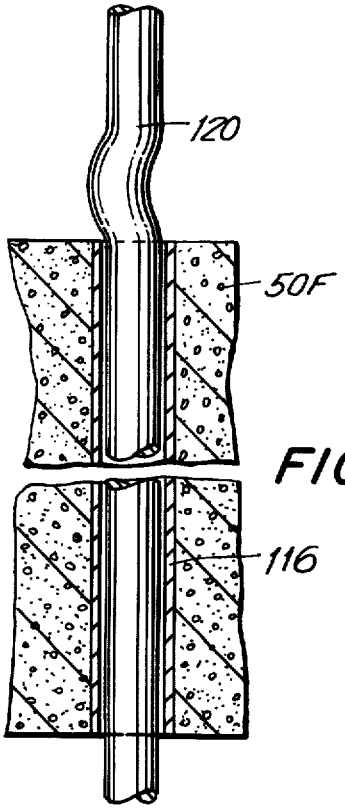
FIG. 17 is a sectional view depicting the insert of FIG. 14 secured in the resultant concrete structure and having a structural member disposed therein.
Figure 16:
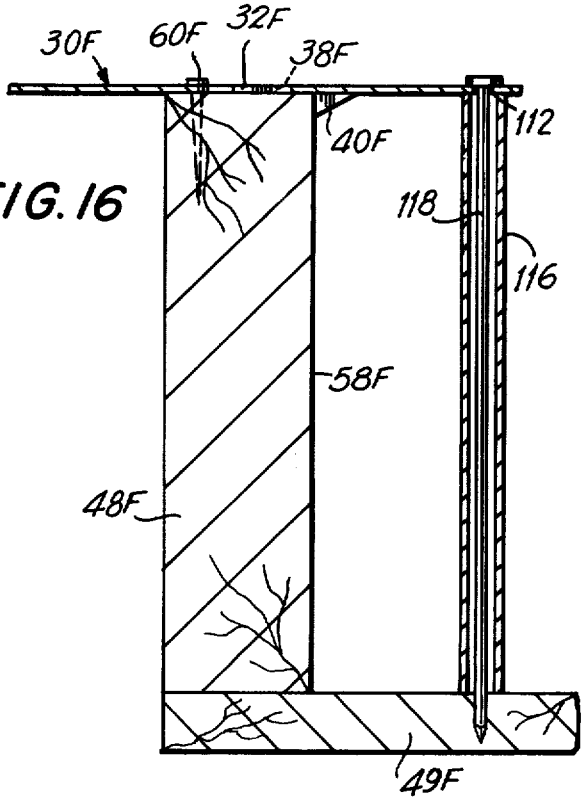
FIG. 16 is a sectional view taken on the line 16—16 of FIG. 15.

With reference to FIG. 13, there is depicted another method of securing the anchor bolt 100 to the tab, herein designated 30E, which tab would be formed having a substantially planar configuration. In this instance, the threaded upper end portion 104 would be force fitted into the block member 80D and the tab 30E would be provided with a slight detent 108 which is tack welded to the upper end 106 of the threaded end portion 104, as indicated by the reference numeral 110. In the removal of the tab 30E and block member 80D, after the concrete structure 50D has hardened, all that is required is to twist the tab 30E to thereby destroy the tack weld 110.

Figure 12:
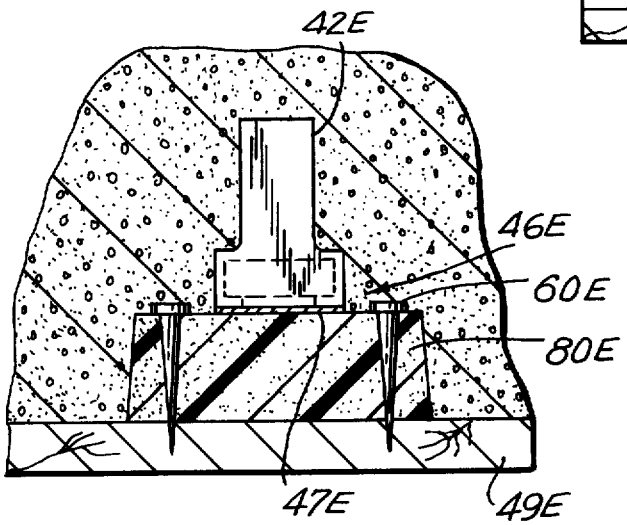
FIG. 12 is a sectional view depicting another embodiment of the invention.

In those instances where it is desired to locate and secure an insert or anchor in a recessed position with respect to the bottom surface of a concrete structure, the same can easily be accomplished by employing the anchor and insert positioning and locating device 46E depicted in FIG. 12. In this instance, a foam block member 80E which may have positioning indicia (not shown) thereon is positionable with respect to the bottom horizontal wooden form member 49E by means of nails 60E driven through the block member 80E. The insert 42E is secured, preferably in the center of the block member 80E, by means of an adhesive layer 47E.

With reference now to FIGS. 14 through 17, there is depicted a further embodiment of the present invention for use in positioning and locating sleeves or similar anchoring devices in a concrete structure. In this embodiment, an elongated tab member 30F is provided with a centering aperture 32F, a series of holes 38F, a pair of tangs 40F and an aperture 112 formed in the contoured forward end portion 114 of the tab 30F, which forward end portion is of reduced width with respect to the wooden concrete form 48F by alignment of the aperture 32F with respect to the center line 52F and by disposing the tangs 40 in abutting engagement with the interior side wall 58F of the wooden form 48F. The tab 30F is then removably secured to the wooden form by means of nails 60F. A hollow sleeve 116, herein depicted having a cylindrical configuration, is then interposedly placed between the underside of the forward portion 114 of the tab 30F and the upper surface of the horizontal wooden concrete form member 49F. After the sleeve 116 has been vertically aligned, it is locatingly secured with respect to the wooden concrete form members 48F and 49F by inserting an elongated nail 118 through the aperture 112 and then driving the forward end of the nail into the wooden form member 49F. It is to be noted that the sleeve may have the upper end thereof secured, such as by tack welding to the tab 30F, while the lower end of the sleeve may be formed with a tapered point or nail edge.

After the resultant concrete structure 50F has been poured and has hardened, the tab 30F is pried from the form 48F and the nail 118 is pried from the form 49F thereby leaving the sleeve 116 properly located within said concrete structure. Thereafter, a structural member, such as 120, may be positioned with respect to the concrete structure by being passed through the sleeve 116.

Figure 18:
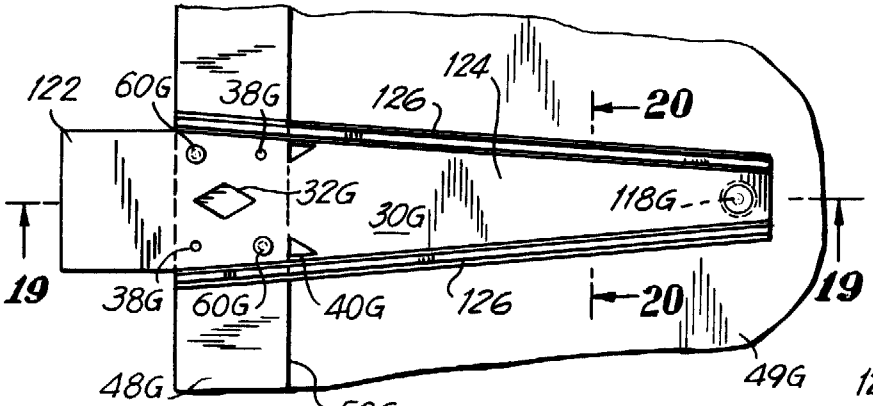
FIG. 18 is a top view of another embodiment of the device, similar to the embodiment depicted in FIG. 14.
Figure 19:
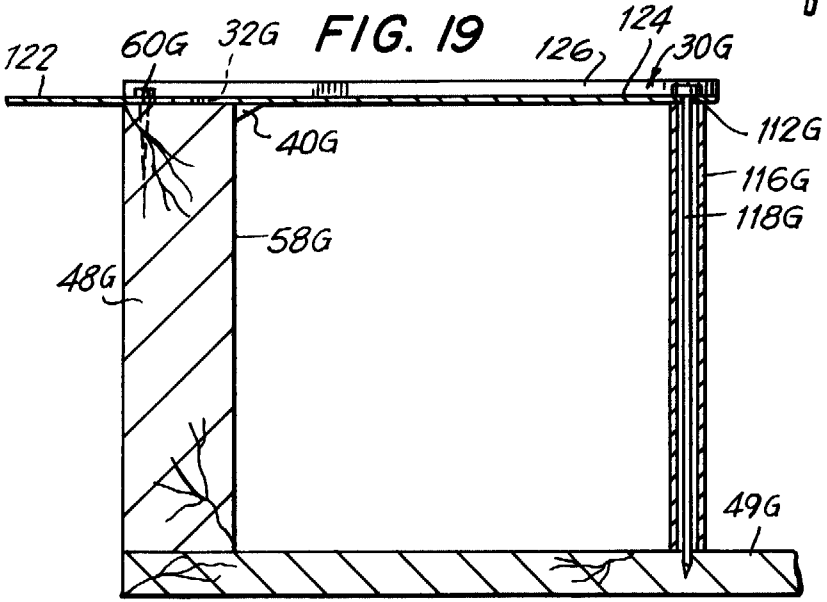
FIG. 19 is a sectional view taken on the line 19—19 of FIG. 18.

A modified embodiment of the tab 30F is depicted in FIG. 18 and is generally denoted by the reference numeral 30G. The tab 30G is provided with a rear portion 122, of substantially rectilinear configuration and an elongated forward portion 124 having a truncated triangular configuration; the portions 122 and 124 being formed integrally with one another. The outer edges of the portion 124 are provided with ripples or corregations 126 which structurally reinforce the elongated forward end portion 124 of the tab 30G. The tab 30G is used to position and locate a sleeve 116G within the resultant concrete structure. This is accomplished by securing the tab 30G to the wooden concrete form 48G by means of nails 60G, employing the aperture 32G, as discussed hereinbefore, wherein the tangs 40G are disposed in abutting engagement with the interior side wall 58G of the wooden concrete form. The sleeve 116G is positionally and fixedly located by driving an elongated nail 118G into the horizontal wooden concrete form member via the aperture 112G.

It is herein to be noted that the corregations 126 give added strength to the forward portion 124 of the tab 30G so as to prevent any buckling of the same whould a workman inadvertently step thereon.

Figure 21:
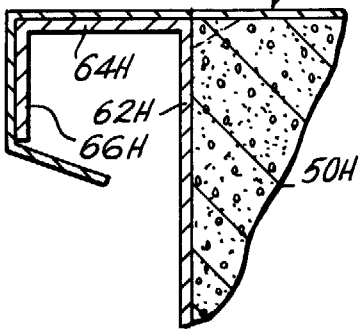
FIG. 21 is a sectional view similar to FIG. 19 depicting the device in conjunction with a metal concrete form and resultant poured concrete structure.

Another embodiment of the present invention is depicted in FIG. 21 wherein the corregated tab, denoted 30H is positioned with respect to a metal concrete form 62H having flanges 64H and 66H. The efficacy of the securement of the tab with respect to the metal concrete form has been hereinbefore discussed in conjunction with FIG. 4. Thus, by utilizing the tab 30H, in conjunction with a metal concrete form, a sleeve (not shown) will be locatingly fixed within the concrete structure 50H.

Figure 22:
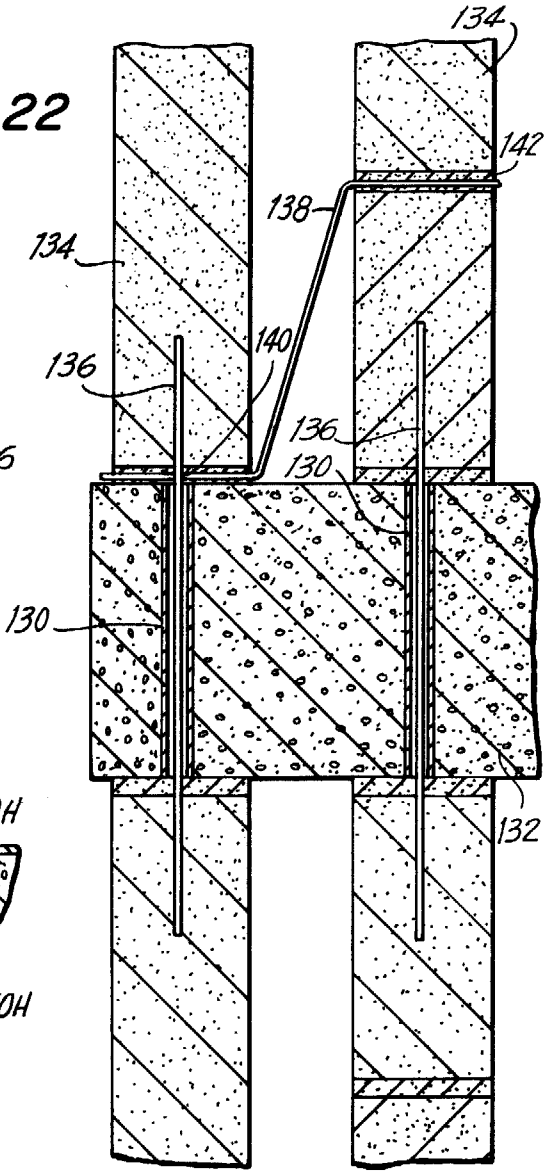
FIG. 22 is a sectioned elevational view of a new concrete reinforcing and shear transferring system which initially utilizes the devices depicted in FIGS. 14 through 20.
Figure 20:
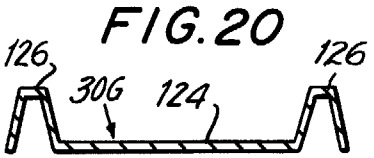
FIG. 20 is a sectional view taken on the line 20—20 of FIG. 18.

It is herein to be noted that the tabs 30F, 30G and 30H may be provided with a plurality of apertures 112, so as to locate a plurality of sleeves within a resultant concrete structure. This type of configuration is depicted in FIG. 22, wherein a pair of sleeves, herein designated 130, are locatingly secured within a horizontally disposed concrete slab 132 which may be a floor slab. Concrete wall members 134 are secured with respect to the slab 132 in a well known manner. Structural reinforcing members 136 are vertically disposed within adjacently positioned ones of the concrete wall members 134 by passing through the sleeves 130, thereby reinforcingly securing the wall members 134 with respect to the concrete slab 132 and serving to transfer any horizontal shear imparted from the vertical wall members or wythes 134 to the horizontal slab 132. Reinforcing structural members 136 are shown piercing the flashing member 138 by extending through an aperture 140 formed therein. The other end of the flashing being secured within a mortar joint 142 formed between adjacent ones of the vertical concrete wythes 134.

It is thus seen that I have provided a new and novel insert and anchor positioning and locating device for use in conjunction with concrete forms which may be easily and simply installed by ordinary workmen or laborers on a construction site and without necessitating the skills of specialized artisans in the construction industry, and which devices have the unnecessary positioning portions of the devices capable of easy removal after the inserts or anchors have been locatingly secured in the resultant poured concrete structures.

It is herein to be noted that the terms "insert" and "insert member" as used herein, and in the claims hereinafter, are intended to generally include insert members, anchor members and similar devices which require predetermined orientations when used in concrete structures.

While I have shown and described the various embodiments of the present invention, and due to the detailed disclosure of said embodiments, it will be obvious and readily apparent to those skilled in the art that there are many modifications, changes and improvements which may be made in the present invention, as herein envisioned, without departing from the spirit and scope of the invention, as herein disclosed.

What is claimed is:

1. An insert positioning and locating device for initially positioning said device with respect to a concrete form in order to locatingly secure said insert in a predetermined orientation with respect to a thereafter poured concrete structure, said device comprising a tab member, and an insert member, means for detachably securing said insert member to said tab member in predetermined relationship, said device including means for lateral and longitudinal positioning thereof with respect to said concrete form, said tab member having means for permitting removable positional securement thereof to said concrete form, and said removal of said tab member from said concrete form and detachment thereof from said insert permitting of predetermined locational securement of said insert with respect to said resultant concrete structure.

2. An insert positioning and locating device in accordance with claim 1, including recessing means secured to said tab member and said insert member for locatingly positioning said insert member in recessed relationship with respect to at least one surface of said resultant concrete structure.

3. An insert positioning and locating device in accordance with claim 2, wherein said recessing means comprises a frangible block member interposed between said tab member and said insert member.

4. An insert positioning and locating device in accordance with claim 3, wherein said frangible block member is fabricated of an expanded plastic material.

5. An insert positioning and locating device in accordance with claim 4, wherein said expanded plastic material is polystyrene.

6. An insert positioning and locating device in accordance with claim 3, wherein said frangible block member has a rectangular cross-section.

7. An insert positioning and locating device in accordance with claim 3, wherein said frangible block member has a triangular cross-section.

8. An insert positioning and locating device in accordance with claim 1, wherein said tab member has a substantially planar configuration, and said means for longitudinally positioning said tab member with respect to said concrete form comprises an aperture of predetermined geometrical configuration capable of being aligned with a preselected type of marking on said concrete form.

9. An insert positioning and locating device in accordance with claim 1, wherein said tab member has a substantially planar configuration, and said means for laterally positioning said tab member with respect to said concrete form comprises a pair of detents formed integrally with said tab member and which depend downwardly therefrom.

10. An insert positioning and locating device in accordance with claim 8, wherein said means for laterally positioning said tab member with respect to said concrete form comprises a pair of detents formed integrally with said tab member and which depend downwardly therefrom.

11. An insert positioning and locating device in accordance with claim 10, wherein said means for permitting removable positional securement of said tab member to said concrete form comprises a plurality of bores formed in the outer end of said tab member, said bores being disposed in preselected relationship with said concrete form and adapted to have pin members inserted through selected ones of said bores, and said pin members engaging said concrete form for positional securement of said tab member to said concrete form.

12. An insert positioning and locating device in accordance with claim 10, wherein said means for permitting removable positional securement of said tab member comprises the outer end of said tab member having a plurality of longitudinally extending slits forming a plurality of segregated end portions, and said end portions being capable of being bent into substantially conformal engagement with said concrete form for positional securement of said tab member to said concrete form.

13. An insert positioning and locating device in accordance with claim 8, wherein said aperture is of diamond-shaped configuration.

14. An insert positioning and locating device in accordance with claim 13, wherein said diamond-shaped aperture is laterally centered with respect to said tab member, and said preselected marking on said concrete form is a centerline.

15. An insert positioning and locating device in accordance with claim 1, wherein said means for detachably securing said insert member to said tab member comprises an adhesive layer interposed therebetween.

16. An insert positioning and locating device in accordance with claim 15, wherein said adhesive layer is fabricated of double faced adhesive tape.

17. An insert positioning and locating device in accordance with claim 16, wherein said insert member is detachably secured to the inner end of said tab member.

18. An insert positioning and locating device in accordance with claim 3, wherein said block member is secured to said tab member by an adhesive layer interposed therebetween, and said block member is secured to said insert member by an adhesive layer interposed therebetween.

19. An insert positioning and locating device in accordance with claim 18, wherein said adhesive layers are fabricated of double faced adhesive tape.

20. An insert positioning and locating device in accordance with claim 19, wherein said frangible block member has a rectangular configuration.

21. An insert positioning and locating device in accordance with claim 20, wherein said means for laterally positioning said tab member with respect to said concrete form comprises the outer end of said block member which is capable of being disposed in abutting engagement with said concrete form.

22. An insert positioning and locating device in accordance with claim 21, wherein said means for longitudinally positioning said tab member with respect to said concrete form comprises an aperture of predetermined geometrical configuration capable of being aligned with a preselected type of marking on said concrete form.

23. An insert positioning and locating device in accordance with claim 3, wherein said tab member comprises an upper wall member, a pair of side wall members, and
a pair of flanges,
said side wall members being connected to said upper wall member and depending therefrom,
said flanges being secured to said side wall members and extending inwardly therefrom,
said flanges being disposed in substantially coplanar relationship with respect to said upper wall member,
said block member being positionally secured between said upper wall member and said inwardly disposed flanges of the tab member, and
said insert member being secured to said block member by means of an adhesive layer interposed therebetween.

24. An insert positioning and locating device in accordance with claim 23, wherein
said adhesive layer is fabricated of double faced adhesive tape.

25. An insert positioning and locating device in accordance with claim 23, wherein
said block member is positionally secured within the confines of that portion of said tab member as is defined by said upper wall member, said side wall members and said inwardly extending flanges.

26. An insert positioning and locating device in accordance with claim 23, wherein
said means for laterally positioning said tab member with respect to said concrete form comprises an outer end of said block member which is capable of being disposed in abutting engagement with said concrete form.

27. An insert positioning and locating device in accordance with claim 26, wherein
said means for longitudinally positioning said tab member with respect to said concrete form comprises an aperture of predetermined geometrical configuration capable of being aligned with a preselected type of marking on said concrete form.

28. An insert positioning and locating device in accordance with claim 3, wherein
said tab member comprises
an upper wall member,
a pair of side wall members, and
a pair of flanges,
said side wall members being connected to said upper wall member and depending therefrom,
said flanges being secured to said side wall members and extending inwardly therefrom,
said flanges being disposed in substantially coplanar relationship with respect to said upper wall member,
said block member being positionally secured between said upper wall member and said inwardly disposed flanges of the tab member, and
means for detachably securing said flanges to said insert member.

29. An insert positioning and locating device in accordance with claim 28, wherein
said last mentioned detachable securing means comprises tack welds formed between said flanges and said insert member.

30. An insert positioning and locating device in accordance with claim 29, wherein
said means for laterally positioning said tab member with respect to said concrete form comprises the outer end of said block member which is capable of being disposed in abutting engagement with said concrete form.

31. An insert positioning and locating device in accordance with claim 30, wherein
said means for longitudinally positioning said tab member with respect to said concrete form comprises an aperture of predetermined geometrical configuration capable of being aligned with a preselected type of marking on said concrete form.

32. An insert positioning and locating device in accordance with claim 1, wherein
said tab member having the inner end thereof formed with a nail edge,
said inner nail edge being capable of being positionally secured to one portion of the concrete form and said outer end of said tab member being removably positionally secured with respect to another portion of said concrete form,
said inner and outer ends of said tab member being disposed in substantially perpendicular relationship, and
said insert member being detachably secured to said inner end of said tab member.

33. An insert positioning and locating device in accordance with claim 32, wherein
said means for longitudinally positioning said tab member with respect to said concrete form comprises an aperture of predetermined geometrical configuration capable of being aligned with a preselected type of marking on said concrete form.

34. An insert positioning and locating device in accordance with claim 33, wherein
said means for detachably securing said insert member to said tab member comprises an adhesive layer interposed therebetween.

35. An insert positioning and locating device in accordance with claim 34, wherein
said adhesive layer is fabricated of double faced adhesive tape.

36. An insert positioning and locating device in accordance with claim 1, wherein
said tab member has an inner end portion and an outer end portion,
said outer end portion having a substantially planar configuration and being capable of removable positional securement to said concrete form,
said inner end portion having a substantially right triangular configuration, and
said insert member being detachably secured to the hypotenuse leg of said right triangular configuration.

37. An insert positioning and locating device in accordance with claim 36, wherein
said means for detachably securing said insert member to said tab member comprises an adhesive layer interposed therebetween.

38. An insert positioning and locating device in accordance with claim 37, wherein
said adhesive layer is fabricated of double faced adhesive tape.

39. An insert positioning and locating device in accordance with claim 36, wherein
said means for laterally positioning said tab member with respect to said concrete form comprises one of the legs of said right triangular configuration which is capable of being disposed in abutting engagement with said concrete form.

40. An insert positioning and locating device in accordance with claim 39, wherein
said means for longitudinally positioning said tab member with respect to said concrete form comprises an aperture of predetermined geometrical configuration capable of being aligned with a preselected type of marking on said concrete form.

41. An insert positioning and locating device in accordance with claim 36, wherein
the interior of said right triangular inner end portion of said tab member is hollow.

42. An insert positioning and locating device in accordance with claim 36, wherein
the interior of said right triangular inner end portion of said tab member has a conformal frangible block member of substantially right triangular configuration disposed therewithin.

43. An insert positioning and locating device in accordance with claim 1, wherein
said insert member comprises an anchor bolt and a bolt plate secured with respect to one another,
said bolt having an upper portion extending through said plate,
a frangible block member disposed between said tab member and said bolt plate,
said bolt upper end portion being fixedly disposed within said frangible block member, and
said block member being secured to said tab member by an adhesive layer interposed therebetween.

44. An insert positioning and locating device in accordance with claim 43, wherein
an adhesive layer is interposed between said block member and said bolt plate.

45. An insert positioning and locating device in accordance with claim 44, wherein
said adhesive layers are fabricated of double faced adhesive tape.

46. An insert positioning and locating device in accordance with claim 1, wherein
said insert member comprises an anchor bolt and a bolt plate secured with respect to one another,
said bolt having an upper portion extending through said plate,
said tab member comprises
an upper wall member,
a pair of side wall members, and
a pair of flanges,
said side wall members being connected to said upper wall member and depending therefrom,
said flanges being secured to said side wall members and extending inwardly therefrom,
said flanges being disposed in substantially coplanar relationship with respect to said upper wall member,
said block member being positionally secured between said upper wall member and said inwardly disposed flanges of the tab member, and
a frangible block member being positionally secured between said upper wall member and said bolt plate,
said bolt upper end portion being disposed within said frangible block member, and
means for detachably securing said flanges to said bolt plate.

47. An insert positioning and locating device in accordance with claim 46, wherein
said last mentioned detachable securing means comprises tack welds formed between said flanges and said bolt plate.

48. An insert positioning and locating device in accordance with claim 1, wherein
said insert member comprises an anchor bolt and a bolt plate secured with respect to one another,
said bolt having an upper portion extending through said plate,
a frangible block member disposed between said tab member and said bolt plate,
said bolt upper end portion being disposed within said frangible block member, and
means for detachably securing said tab member to the uppermost part of said bolt upper end portion.

49. An insert positioning and locating device in accordance with claim 48, wherein
said last mentioned detachable securing means comprises a tack weld.

50. An insert positioning and locating device in accordance with claim 1, wherein
said tab member comprises a frangible block, and
said frangible block serving to recess said insert member with respect to at least one surface of said resultant concrete structure.

51. An insert positioning and locating device in accordance with claim 50, wherein
said means for detachably securing said insert member to said tab member comprises an adhesive layer interposed therebetween.

52. An insert positioning and locating device in accordance with claim 51, wherein
said adhesive layer is fabricated of double faced adhesive tape.

53. An insert positioning and locating device in accordance with claim 1, wherein
said insert member is provided with a bore,
said means for detachably securing said insert member with respect to said tab member includes,
an aperture formed in the inner end of said tab member, and
an elongated pin member extending through said bore in said insert member and said aperture in said tab member.

54. An insert positioning and locating device in accordance with claim 53, wherein
said bore and said aperture are disposed in coaxial alignment.

55. An insert positioning and locating device in accordance with claim 54, wherein
said elongated pin member is formed with a pointed lower end portion, and
said pointed end portion is capable of being detachably secured to one part of the concrete form.

56. An insert positioning and locating device in accordance with claim 55, wherein
said pin member is provided with an enlarged head portion, and
said enlarged head portion is disposed in abutting engagement with the upper surface of said tab member.

57. An insert positioning and locating device in accordance with claim 56, wherein
said insert member is a substantially vertically disposed sleeve.

58. An insert positioning and locating device in accordance with claim 56, wherein said tab member has a substantially planar configuration, and said means for longitudinally positioning said tab member with respect to said concrete form comprises an aperture of predetermined geometrical cofiguration capable of being aligned with a preselected type of marking on another part of said concrete form.

59. An insert positioning and locating device in accordance with claim 56, wherein said tab member has a substantially planar configuration, and said means for laterally positioning said tab member with respect to said concrete form comprises a pair of detents formed integrally with said tab member and which depend downwardly therefrom.

60. An insert positioning and locating device in accordance with claim 58, wherein said means for laterally positioning said tab member with respect to said concrete form comprises a pair of detents formed integrally with said tab member and which depend downwardly therefrom.

61. An insert positioning and locating device in accordance with claim 56, wherein said means for permitting removable positional securement of said tab member comprises the outer end of said tab member having a plurality of longitudinally extending slits forming a plurality of segregated end portions, and said end portion being capable of being bent into substantially conformal engagement with said concrete form for positional securement of said tab member to said concrete form.

62. An insert positioning and locating device in accordance with claim 53, wherein said tab member has a substantially planar and truncated conical configuration, and said tab member having the longitudinal edges thereof reinforced.

63. An insert positioning and locating device in accordance with claim 62, wherein said reinforced longitudinal edges of said tab member comprise corrugations formed integrally with said tab member.

64. An insert positioning and locating device in accordance with claim 53, wherein said device comprises a plurality of insert members, each of said insert members being provided with a bore, said means for detachably securing said insert members with respect to said tab member includes, a plurality of apertures formed in the inner end of said tab member, each of said apertures being disposed in coaxial alignment with a corresponding one of said bores formed in said insert members, and an elongated pin member extending through each of said coaxially aligned bores and apertures.

65. An insert positioning and locating device in accordance with claim 64, wherein said elongated pin members are formed with pointed lower end portions, and said pointed end portions are capable of being detachably secured to one part of the concrete form.

66. An insert positioning and locating device in accordance with claim 1, wherein said tab member has the inner end thereof formed with a nail edge, said inner nail edge being capable of being positionally secured to one portion of the concrete form and said outer end of said tab member being removably positionally secured with respect to another portion of said concrete form, and said insert member being detachably secured to said inner end of said tab member.

* * * * *